US005330143A

United States Patent [19]

Rich et al.

[11] Patent Number: 5,330,143

[45] Date of Patent: Jul. 19, 1994

[54] CRAFT STAND

[76] Inventors: Homer C. Rich, 1100 S. Noland Rd., Independence, Mo. 64050; Robert E. Morgan, 2255 NE. Porter Rd., Blue Springs, Mo. 64014

[21] Appl. No.: 982,620

[22] Filed: Nov. 27, 1992

[51] Int. Cl.[5] ..... D05C 1/02

[52] U.S. Cl. ..... 248/161; 38/102.2; 223/120

[58] Field of Search ..... 248/161, 309.1, 316.4; 38/102.1, 102.2, 103; 223/120

[56] References Cited

U.S. PATENT DOCUMENTS

| | | | |
|---|---|---|---|
| 699,263 | 5/1902 | Vosler . | |
| 707,353 | 8/1902 | Post . | |
| 807,857 | 12/1905 | Palmenberg . | |
| 1,497,979 | 6/1924 | Jaworek | 38/102.2 |
| 1,659,925 | 2/1928 | Schmidt | 38/102.2 |
| 1,829,964 | 5/1930 | Randall . | |
| 3,774,325 | 11/1973 | Johnson et al. | 38/102.2 |
| 3,855,718 | 12/1974 | Parsons et al. | 38/102.2 |
| 3,955,722 | 5/1976 | Bard | 223/120 |
| 4,175,343 | 11/1979 | Mathews | 38/102.1 |
| 4,501,080 | 2/1985 | Rich | 38/102.7 |
| 4,590,695 | 5/1986 | McGillivray | 38/102.2 |

FOREIGN PATENT DOCUMENTS

| | | |
|---|---|---|
| 283665 | 3/1991 | Italy . |
| 278515 | 10/1927 | United Kingdom . |
| 459068 | 1/1936 | United Kingdom . |

*Primary Examiner*—Richard K. Seidel
*Assistant Examiner*—Hwei-Siu Payer
*Attorney, Agent, or Firm*—Litman, McMahon & Brown

[57] ABSTRACT

An improved craft stand for securing craft frames and craft materials thereto comprising a base and having an upright telescoping standard secured thereto. The telescoping standard including a lower hollow member and an upper telescoping member. The standard further includes a tensioning assembly for securing the upper telescoping member in a desired extended position with respect to the lower hollow member. A universal joint assembly is mounted on an upper end of the standard. A cross arm is connected at its middle to the universal joint assembly and includes opposite ends. A pair of clamp assemblies are attached to the cross arm at its opposite ends. The clamp assemblies are adapted for securing a craft type frame or other items to be worked on by a craft practitioner. Adapter blocks are provided which are securable to the clamp assemblies such that a portion of the adapter block extends above the clamp assemblies. An inner surface of an inner hoop of a hoop type craft frame is securable to the adapter blocks such that an outer hoop is freely and removably securable to the inner hoop without having to release the inner hoop from the clamp assemblies.

15 Claims, 3 Drawing Sheets

Fig.5.
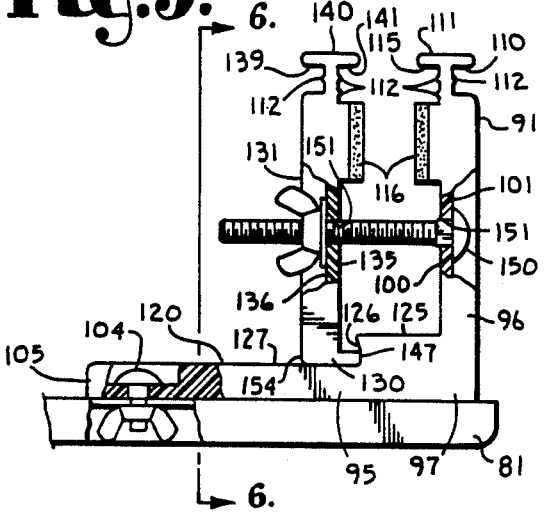
Fig.6.
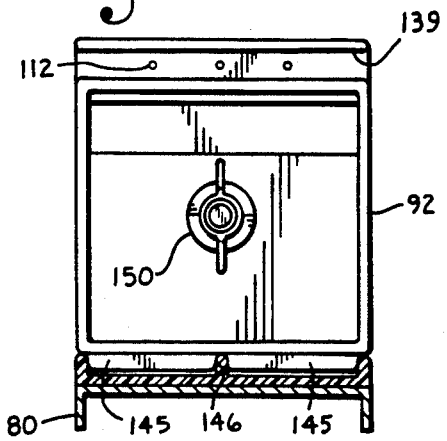
Fig.7.
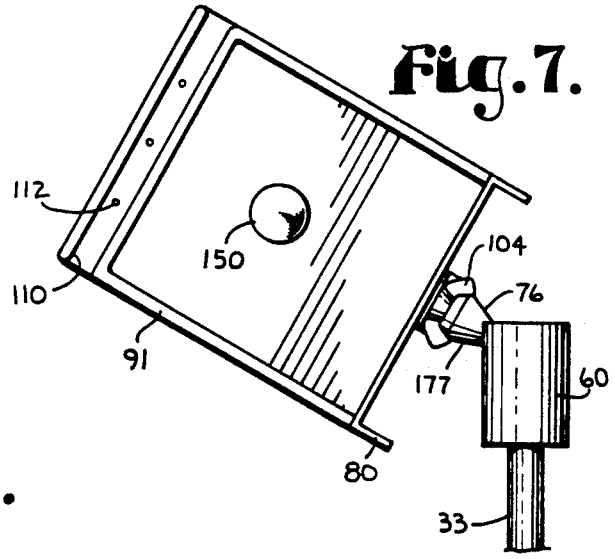
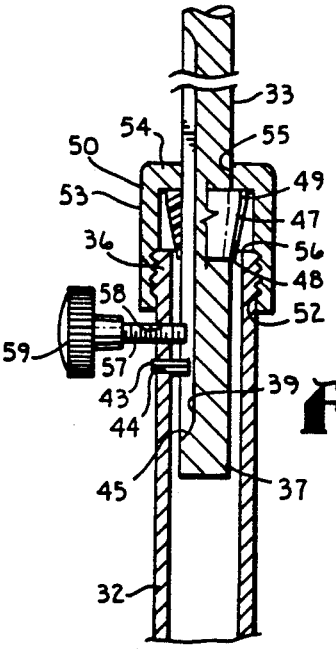
Fig.9.
Fig.8.
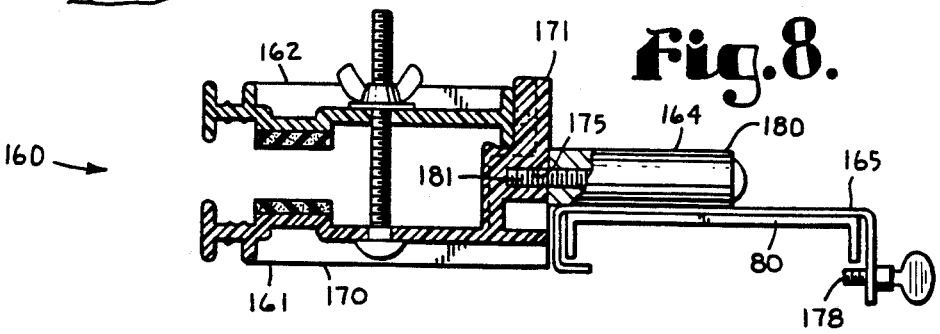

Fig. 11.
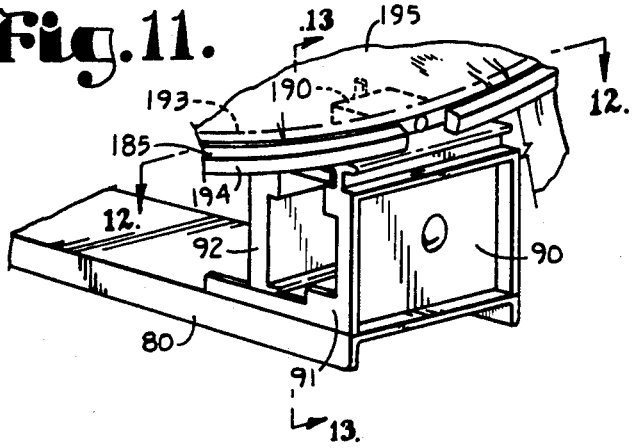
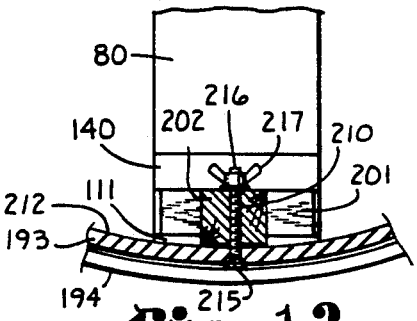
Fig. 12.
Fig. 13.
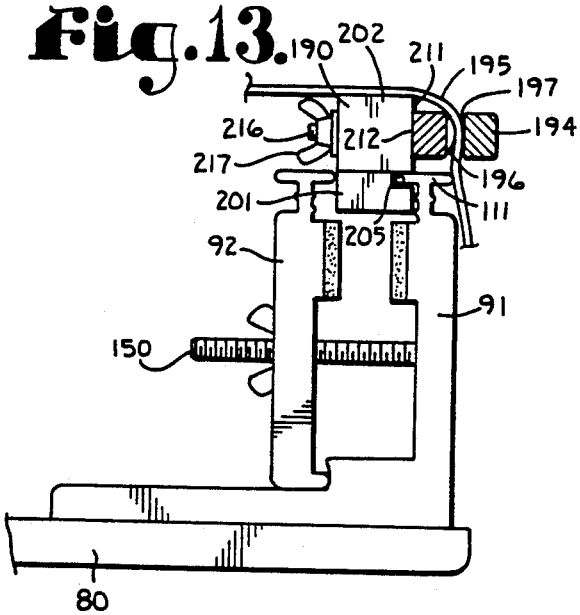
Fig. 14.
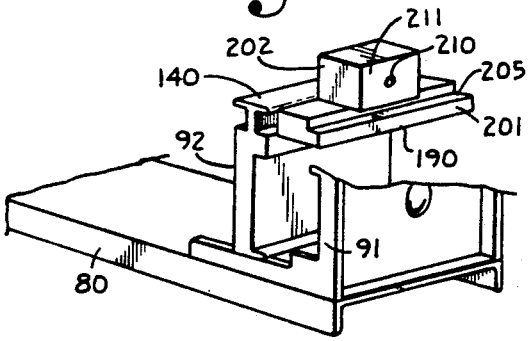

CRAFT STAND

BACKGROUND OF THE INVENTION

The present invention generally relates to improvements to a craft stand.

A variety of stands have previously been developed for supporting workpieces or craft frames such as stretcher frames, embroidery hoops and the like in predetermined positions. These stands generally allow a user to support the workpiece or craft frame on the stand so that the user has both hands available to perform the desired craft. When working on various workpieces, it is helpful to be able to position the workpiece in a wide range of orientations. Many previous stands were limited in the ability to position the workpiece in a wide range of orientations. The ability to support a wide range of workpieces and craft frames on the craft stand also affords practical advantages, however many previous stands were limited in the types of workpieces that could be used with the stand.

The means used for supporting various workpieces and craft frames on the craft stand needs to be versatile enough to support, hold or secure various types of workpieces and frames. The means for supporting these workpieces and frames should also allow the workpiece or frame to be supported in a wide range of orientations. Also the means for supporting the workpieces and frames must function to securely hold the workpiece or frame without damaging the materials of the workpiece and of the craft.

SUMMARY OF THE INVENTION

The present invention provides an improved craft stand capable of supporting a wide range of craft materials and frames in a wide range of orientations. The craft stand includes a base having a base cylinder and a plurality of legs extending radially outward therefrom. A telescoping standard or post is threadingly secured at one end to the base cylinder so as to extend vertically. A universal joint assembly is mounted on the upper end of the standard. A cross arm is medially secured to the universal joint and includes clamp assemblies at opposite ends for securing various craft frames or materials. An additional clamp assembly is selectively securable to the cross arm and allows craft items to be supported to the side of the cross arm.

Each clamp assembly includes a first clamp member and a second clamp member. The first clamp member includes an elongate base and an upright portion extending perpendicularly thereto. The elongate base is secured to the cross arm by a bolt extending through a slot in the cross arm such that the first clamp member may be rotated 360° about the bolt and may be slidingly advanced along the slot.

The second clamp member includes a base portion and an upright portion extending generally perpendicularly thereto. The second clamp member is positionable on the first clamp member such that the base portion of the second clamp member is supported on the elongate base of the first clamp member. A spacer integrally formed with the first clamp member at a lower portion of the upright portion spaces lower portions of the first and second clamp members apart. A wing nut secured to a bolt extending through aligned apertures medially located in the upright portions of the first and second clamp members can be tightened to advance an upper clamping edge of the second clamp member towards an upper clamping edge of the first clamp member. Similarly the wing nut can be loosened to allow the upper clamping edge of the second clamp member to be advanced away from the upper clamping edge of the first clamp member.

A strip of foam rubber type material or other biasable material is secured to the inner opposed surfaces of the first and second clamp members. Crafts may be positioned between the first and second clamp members such that the foam rubber engages the craft so as to grip the material to be secured therebetween in a firm but yielding manner.

An adapter block is provided which may be secured to the clamp assemblies such that a portion of the adapter block extends above the clamp assembly to which it is secured. An inner hoop of a hoop type craft frame may be secured to the portion of each adapter block extending above the clamp assembly such that an inner surface of the inner hoop engages the adaptor blocks. Craft material to be worked on may be positioned over the inner hoop, and an outer hoop of the hoop type craft frame may then be positioned over and around the inner hoop with the material extending therebetween so as to secure the material thereto.

OBJECTS AND ADVANTAGES OF THE INVENTION

Therefore, it is an object of the present invention to provide a stand for supporting a variety of crafts; to provide such a stand wherein the craft is positionable in a wide range of orientations; to provide such a stand which is adapted for height adjustment; to provide such a stand which allows a user relatively free access to the craft; to provide such a stand with clamps for securing the craft to the stand; to provide such a stand wherein the spacing between the clamps is adjustable; to provide such a stand wherein the clamps secure the craft in a firm but yielding manner so as to reduce the likelihood of damage to the craft; to provide such a stand wherein the clamps are particularly well adapted for securing crafts in place; to provide such a stand which can be adapted to secure a hoop type craft frame thereto such that the entire hoop type craft frame does not have to be removed from the clamps each time craft material supported by the hoop type craft frame needs to be repositioned thereon; to provide such a stand which is economical to manufacture, efficient in operation, capable of a long operating life, and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is an enlarged and fragmentary view of the craft stand showing a clamp assembly with portions broken away to show detail.

FIG. 6 is an enlarged cross-sectional view taken along line 6—6 of FIG. 5.

FIG. 7 is an enlarged and fragmentary, side elevational view of the craft stand showing the craft stand in a different alignment.

FIG. 8 is an enlarged cross-sectional view of an attachable clamp taken along line 8—8 of FIG. 1 with portions broken away to show detail thereof.

FIG. 9 is an enlarged and fragmentary view taken along line 9—9 of FIG. 1 with portions broken away to show detail thereof.

FIG. 11 is an enlarged and fragmentary perspective view of the craft stand as shown in FIG. 1 having a hoop type craft frame secured to an adapter block which is secured to a clamp and having portions broken away to show detail thereof.

FIG. 12 is a cross-sectional view taken along line 12—12 of FIG. 11 with portions broken away to show detail.

FIG. 13 is an enlarged and fragmentary cross-sectional view generally taken along line 13—13 of FIG. 11.

FIG. 14 is an enlarged and fragmentary perspective view of the craft stand as shown in FIG. 1 having an adapter block secured thereto by a clamp assembly and having portions of the clamp assembly broken away to show detail of the adapter block.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
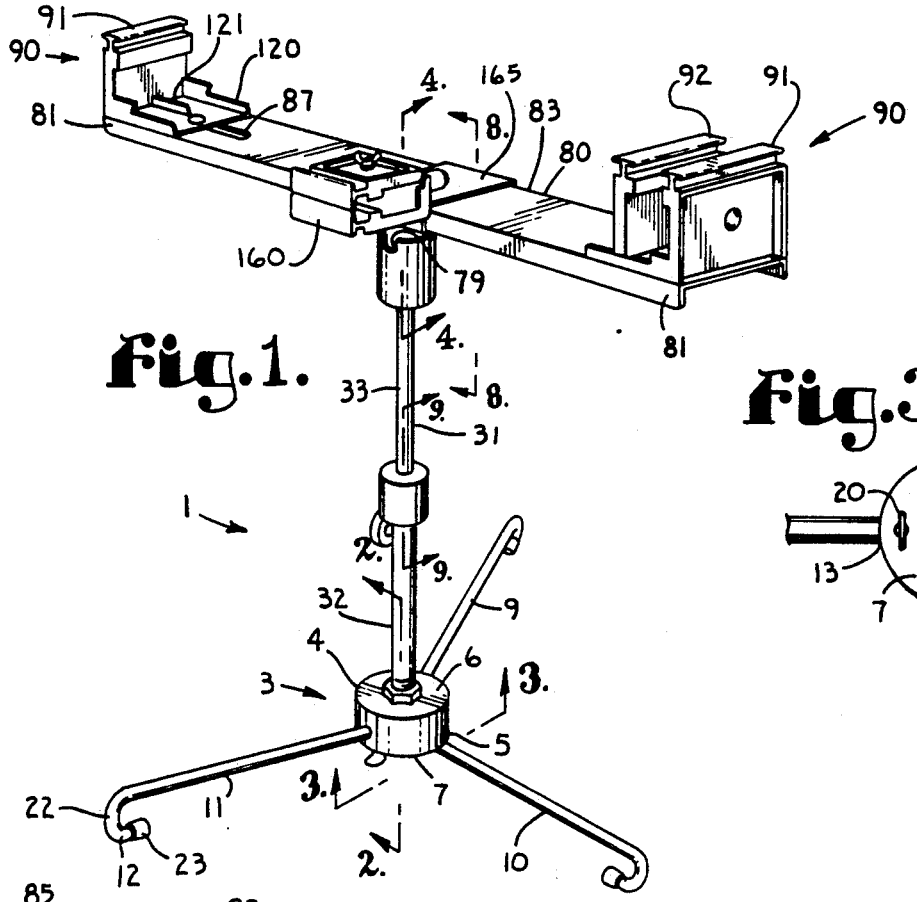
FIG. 1 is a perspective view of the craft stand of the present invention.
Figure 3:
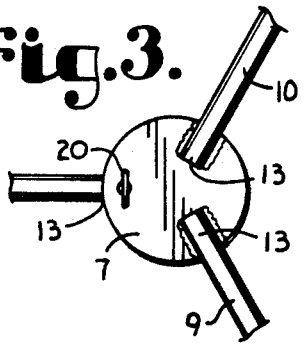
FIG. 3 is an enlarged and fragmentary bottom plan view.
Figure 2:
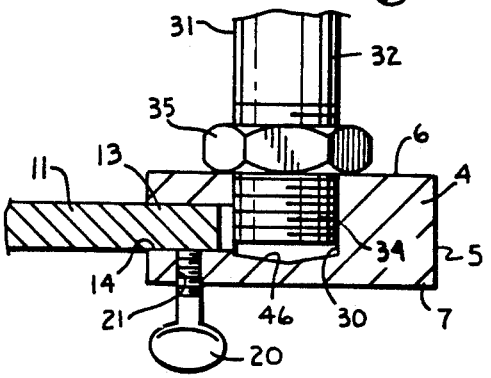
FIG. 2 is an enlarged and fragmentary cross sectional view taken along line 2—2 of FIG. 1.

Referring to the drawings in more detail, the reference numeral 1 generally designates a stand for securing a craft frame or workpiece thereto. The stand includes a base 3 with a base cylinder 4 having an outer surface 5 and upper and lower surfaces 6 and 7. Three legs 9, 10 and 11 extend radially outwardly from the base cylinder 4 at approximately 120 degree intervals. Each leg 9, 10 and 11 includes a distal end 12 and a proximate end 13. As best seen in FIG. 2, the proximate end 13 of the third leg 11 is receivable within a leg receiving aperture 14 in the outer surface 5 of the base cylinder 4 and securable thereto by a set screw 20 threadingly received within leg set screw receiving aperture 21. The proximate ends 13 of legs 9 and 10 are welded to the lower surface 7 of the base cylinder 4 as generally shown in FIG. 3. The legs 9, 10 and 11 are bent so that the distal ends 12 are positioned below the cylindrical base 3 and the distal ends 12 are bent back under themselves to form feet 22 with a cap 23 secured to each distal end 12.

Figure 10:
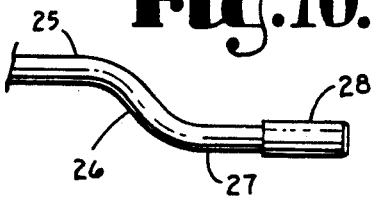
FIG. 10 is an enlarged and fragmentary view of an alternative embodiment of a leg of the craft stand.

It is foreseen that the legs 9, 10 and 11 may be bent in various manners and FIG. 10 shows an alternative embodiment of a leg 25 where a distal end 26 of the leg 25 is angled downward approximately forty five degrees from horizontal and then upward approximately forty five degrees toward horizontal to form a foot 27. A cap 28 is secured to the distal end 26 of the leg 25.

As shown in FIG. 2, a threaded standard receiving aperture 30 extends partially through the base cylinder 4 from the upper surface 6 toward the lower surface 7. An upright telescoping standard 31 comprising a lower hollow member 32 and an upper telescoping member 33 is threadingly secured to the cylindrical base 4. In particular, a threaded lower end 34 of the lower hollow member 32 is threadingly securable within the threaded standard receiving aperture 30 and secured therein by a threaded nut 35. As shown in FIG. 9, an upper end 36 of the lower hollow member 32 is also threaded on an outer surface thereof.

The upper telescoping member 33 having a lower end 37 and an upper end 38 is generally formed from a steel rod and includes a groove, channel or slot 39 extending substantially across the length of the upper telescoping member 33. A universal joint assembly 40 is mounted on the upper end 38 of the upper telescoping member 33.

The upper telescoping member 33 is slidingly received within the lower hollow member 32 and advanceable between a retracted position and an extended position. A pin 43 is inserted into the lower hollow member 32 through a bore 44 and secured thereto by means such as press fitting. The pin 43 is inserted into the lower hollow member 32 so as to extend into the groove 39 of the upper telescoping member 33. When the upper telescoping member 33 is advanced to the extended position, the pin 43 engages a lower end edge 45 of the groove 39 so as to prevent complete removal of the upper telescoping member 33 from the lower hollow member 32. When the upper telescoping member 33 is advanced to the retracted position, the lower end 37 of the telescoping member 33 engages a shoulder or bottom wall 46 in the base cylinder 4 which defines the bottom of the standard receiving aperture 30 such that the lower end 37 of the telescoping member 33 is prevented from advancing therebeyond.

A frusto conical flexible washer 47 is positioned on the upper telescoping member 33. The washer 47 is tapered downward and inward such that the outer diameter of the washer 47 at a lower end 48 thereof is slightly smaller than the inner diameter of the lower hollow member 32 and the outer diameter of the washer 47 at an upper end 49 thereof is slightly larger than the inner diameter of the lower hollow member 32.

The stand 1 further includes a clamping nut 50 comprising a cylindrical sleeve having a threaded inner surface 52 and a gnurled outer surface 53. A top wall 54 extends across an upper end of the clamping nut 50 and includes a telescoping member receiving aperture 55 extending therethrough. The clamping nut 50 is slidingly positioned on the upper telescoping member 33 such that the upper telescoping member 33 extends through the telescoping member receiving aperture 55. The frusto conical washer 47 is positioned between the clamping nut 50 and the upper end 36 of the lower hollow member 32.

When the upper telescoping member 33 is extended to a desired position, the clamping nut 50 is advanced into threaded engagement with the upper end 36 of the lower hollow member 32 and threadingly advanced downward such that the top wall 54 of the clamping nut 50 engages the upper end 49 of the cylindrical washer 47. As the clamping nut 50 is further advanced downward, the cylindrical washer 47 is advanced into the lower hollow member 32 such that an upper inner edge 56 of the lower hollow member 32 engages an outer surface of the cylindrical washer 47 so as to compress the cylindrical washer 47 around the telescoping member 33.

Compression of the cylindrical washer 47 through engagement of the outer surface of the cylindrical washer 47 by the upper inner edge 56 provides resistance to retraction or extension of the upper telescoping member 33 to generally lock the upper telescoping member 33 in a desired extended or retracted position. The cooperation of the clamping nut 50, the frusto conical washer 47 and the lower hollow member 32 generally functions as position securement means for securing the members 32 and 33 in a desired alignment. The frusto conical washer 47 may be slit along its length to facilitate securing and removing the washer 47 onto and from the upper telescoping member 33 and to facilitate compression of the washer 47.

A set screw 57, as seen in FIG. 9, is also provided for use in selectively securing the members 32 and 33 in the desired alignment. The set screw 57 is threadingly received in a set screw receiving bore 58 in the lower hollow member 32. The set screw receiving bore 58 is vertically spaced from (preferably above) the bore 44 for the guide pin 43. The set screw 57 may be threadingly advanced through the set screw receiving bore 58 into the channel 39 of the upper telescoping member 33 and into engagement with the upper telescoping member 33 so as to resist further extension or retraction of the upper telescoping member 33 with respect to the lower hollow member 32. A knob 59 with a gnurled outer surface is secured to a distal end of the set screw 57 to facilitate manual rotation.

The universal joint assembly 40 includes a casing 60 with upper end 61 and lower end 62. A casing bore 63 extends through the casing 60 between its upper and lower ends 61 and 62. A lip 66 restricts the diameter of the casing bore 63 adjacent the casing upper end 61. A plug 67 is fixedly secured within the casing bore 63 adjacent the lower end 62 of the casing 60. A threaded bore 68 extends through the plug 67 for threadingly receiving the upper end 38 of the upper telescoping member 33.

Figure 4:
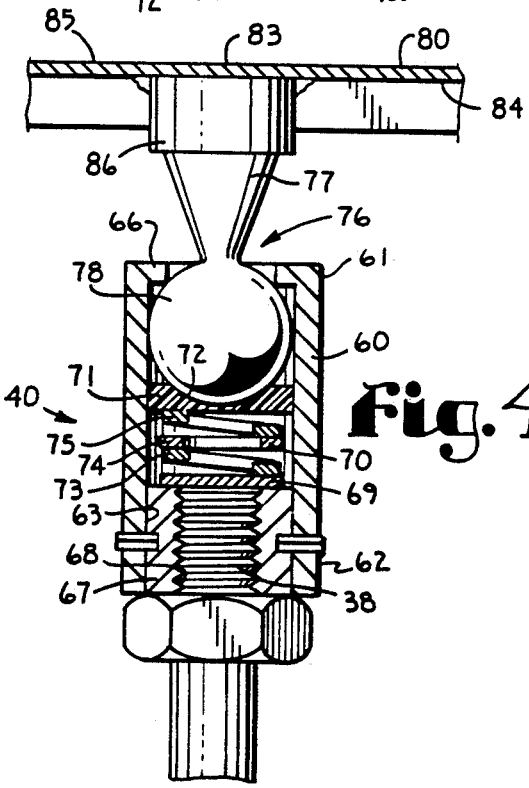
FIG. 4 is an enlarged and fragmentary cross sectional view generally taken along line 4—4 of FIG. 1.

A washer 69 engages the upper end 38 of the telescoping member 33 within the casing bore 63. A helical tension spring 70 is placed on top of the washer 69 within the casing bore 63 and engages a cup washer 71 with an upwardly open depression 72. As seen in FIG. 4, the helical tension spring 70 is formed from a first helical lock washer 73 positioned on washer 69, an intermediate flat washer 74 positioned on top of the first helical lock washer 73, and a second helical lock washer 75 positioned on top of the intermediate flat washer 74.

The universal joint assembly 40 further comprises a ball member 76 having a shank 77 and a ball head 78. The ball head 78 is rotatably received within the casing bore 63 and restrained by the lip 66. The ball head 78 rotatably engages the cup washer 71 within its depression 72.

When the casing 60 is threadingly advanced downward relative to the upper telescoping member 33, the upper end 38 of the telescoping member 33 urges the washer 69, the spring 70 and the cup washer 71 upward so as to compress the ball head 78 between the cup washer 71 and the lip 66 so as to provide resistance to rotation of the ball head 78 and generally lock the ball head 78 in place. Threadingly advancing the casing 60 upward, generally reduces the compression of the cup washer 71 against the ball head 78 and thereby allows the ball head 78 to rotate in the casing 60.

The shank 77 generally extends above the lip 66 of the casing 60 and can generally rotate or pivot freely from a vertical alignment to approximately 40 degrees from vertical. The upper end 61 of the casing 60 includes a cutout portion 79 into which the shank 77 may be advanced so as to generally extend horizontally as seen in FIG. 7.

A cross arm 80 with opposite ends 81, a middle 83, a lower surface 84 and an upper surface 85 is mounted to the universal joint assembly 40. In particular, a base end 86 of the shank 77 of the ball member 76 is secured to the lower surface 84 of the cross arm 80 at the middle 83 thereof preferably by a weld. Elongated slots 87 extend lengthwise through the cross arm 80 at each opposite end 81 thereof.

A clamp assembly 90 is mounted on the cross arm 80 at each opposite end 81. Each clamp assembly 90 comprises a first clamp member 91 and a second clamp member 92. Each first clamp member 91 includes a first member base 95 and a first member upright 96 extending perpendicularly thereto at a front end 97 of the first member base 95. Each first member upright 96 includes an inner surface 100 and an outer surface 101. The first clamp member 91 is securable to the cross arm 80 by a bolt and wingnut assembly 104 extending through the first member base 95 at a rear end 105 thereof and through the elongate slot 87 in a respective opposite end 81 of the cross arm 80.

A first member outer groove 110 is formed in the first member upright 96 at an upper end 111 thereof on the outer surface 101 of the first member upright 96 so as to extend across the width of the first member upright 96. Three linearly aligned bosses 112 extend into the first member outer groove 110 from the outer surface 101 of the first member upright 96. A first member inner groove 115 is formed in the first member upright 96 at the upper end 111 thereof on the inner surface 100 of the first member upright 96 so as to extend across the width of the first member upright 96. Two sets of three linearly aligned bosses 112 extend into the first member inner groove 115 in parallel alignment from the inner surface 100 of the first member upright 96.

A strip of biasable material 116, such as foam rubber, is secured to the inner surface 100 of the first member upright adjacent to and just below the first member inner groove 115. The strip of biasable material 116 extends completely across the width of the first member upright 96. The strip of biasable material 116 is preferably secured to the first member upright 96 by an appropriate adhesive.

Side flanges 120 extend upward from the outer edges of the first member base 95 and a medial flange 121 extends upward generally from the middle of the first member base 95 from the front of the first member base 95 rearward. Each side flange 120 includes a front horizontal edge 125, a vertical edge 126 and a rear horizontal edge 127 spaced below the front horizontal edge 125 by the vertical edge 126. The medial flange 121 has the same height as the rear horizontal edge 127 of the side flanges 120.

Each second clamp member 92 includes a second member base 130 and a second member upright 131 extending perpendicularly to the second member base 130 at a midpoint thereof. Each second member upright 131 includes an inner surface 135 and an outer surface 136.

A second member outer groove 139 is formed in the second member upright 131 at an upper end 140 thereof on the outer surface 136 of the second member upright 131 so as to extend across the width of the second member upright 131. Three linearly aligned bosses 112 extend into the second member outer groove 139 from the outer surface 136 of the second member upright 131. A second member inner groove 141 is formed in the second member upright 131 at the upper end 140 thereof on the inner surface 135 of the second member upright 131 so as to extend across the width of the second member upright 131. Two sets of three linearly aligned bosses 112 extend into the second member inner groove 141 in parallel alignment from the inner surface 135 of the second member upright 131.

A strip of biasable material 116, such as foam rubber, is secured to the inner surface 135 of the second member upright 131 adjacent to and just below the second member inner groove 141. The strip of biasable material 116 extends completely across the width of the second member upright 131. The strip of biasable material 116 is preferably secured to the second member upright 131 by an appropriate adhesive.

A pair of bottom flanges or tabs 145 extend downward from the second member base 130 generally in end to end alignment across a substantial portion of the second member base 130. A medial flange receiving groove 146 is formed between the aligned bottom flanges 145. The second clamp member 92 is positionable on the first clamp member 91 such that the second member base 130 is supported on the medial flange 121 and on the rear horizontal edges 127 of the side flanges 120. Each bottom flange 145 extends between a respective side flange 120 and the medial flange 121. A front edge 147 of the second member base 130 is positioned in abutting relationship with the vertical edge 126 of the first member base 95.

A bolt and wingnut assembly 150 extending through aligned apertures 151 medially positioned in the first member upright 96 and the second member upright 131 may be threadingly tightened or loosened to advance the upper end 140 of the second member upright 131 towards or away from the upper end 111 of the first member upright 96. The bolt and wingnut assembly 150 functions as connector means interconnecting uprights 96 and 131 and adapted for drawing the upper ends 111 and 140 of the uprights 96 and 131 together or away from one another. As the second member upright 131 is advanced from a perpendicular alignment with the first member base 95 towards the first member upright 96 or back to a perpendicular alignment, the second clamp member 92 pivots about the front edge 147 of the second member base 130. As the second member upright 131 is advanced from a perpendicular alignment with the first member base 95 away from the first member upright 96 or back to a perpendicular alignment, the second clamp member 92 pivots about a rear edge 154 of the second member base 130.

Each clamp assembly 90 may be rotated 360 degrees by rotating respective first clamp members 91 about the bolt and wingnut assembly 104. Each clamp assembly 90 may also be independently advanced towards or away from the middle 83 of the cross arm 80 by allowing the bolt and wingnut assemblies 104 to be advanced along respective elongated slots 87 in the opposite ends 81 of the cross arm 80.

The craft stand 1 of the present invention further includes an auxiliary clamp assembly 160 which is removably securable to the cross arm 80. The auxiliary clamp assembly 160 includes a first clamp member 161, a second clamp member 162, a pivotal attachment member 164 and a connector plate 165. The second clamp member 162 of the auxiliary clamp assembly 160 is identical to the second clamp members 92 of the clamp assemblies 90, and the first clamp member 161 of the auxiliary clamp assembly 160 is similar to the first clamp members 91 of the clamp assemblies 90.

A first member upright 170 of the auxiliary clamp assembly 160 is identical to the first member upright 96 of the clamp assemblies 90. A first member base 171 of the auxiliary clamp assembly 160 is similar to the first member base 95 of the clamp assemblies 90 except that the first member base 171 is shorter than the first member base 95 and a threaded pivot pin receiving aperture 175 extends perpendicularly into the first member base 171 medially thereto.

The connector plate 165 is positionable on the cross arm 80 and securable thereto by a set screw 178. The pivotal attachment member 164 includes a cylindrical sleeve 180 fixedly secured to the connector plate 165 and a threaded pivot pin 181 pivotally secured within the cylindrical sleeve 180. An end of the threaded pivot pin 181 extending beyond the cylindrical sleeve 180 is threadingly received by the threaded pivot pin receiving aperture 175 in the first member base 171 of the auxiliary clamp assembly 160.

The first clamp member 161 and the second clamp member 162 generally extend perpendicular to the cross arm 80 when secured thereto. The first clamp member 161 and the second clamp member 162 are rotatable 360 degrees about the pivot pin 181. The first clamp member 161 and the second clamp member 162 of the auxiliary clamp assembly 160 generally function in the same manner as the first clamp members 91 and the second clamp members 92 of the clamp assemblies 90.

The clamp assemblies 90 are used to secure items to the craft stand 1. A portion of an item to be secured to the craft stand 1 can be positioned between the first and second clamp members 91 and 92 between the strips of biasable material 116 or in the inner grooves 115 and 141. The strips of biasable material 116 helps reduce the likelihood of damaging items secured in the clamp assemblies 90. The bosses 112 in the grooves 110, 115, 139 and 141 are adapted to engage items secured therein and prevent slippage.

The clamp assemblies 90 can also be used to secure an item to the frame 1 by positioning the item between the clamp assemblies 90 and advancing the clamp assemblies 90 toward one another until the clamp assemblies 90 engage opposite sides of the item so as to secure the item therebetween.

FIG. 11 shows a hoop type craft frame 185 secured to the craft stand 1 in an alternative manner using an adapter block 190. The hoop type craft frame 185 comprises an inner hoop 193 having a fixed diameter and an outer hoop 194 having an adjustable diameter. Craft material 195 to be worked on is positioned on top of the inner hoop 193 and the outer hoop 194 is then positioned on top of the craft material 195 and around the inner hoop 193 such that the craft material 195 extends between an outer surface 196 of the inner hoop 193 and an inner surface 197 of the outer hoop 194. The diameter of the outer hoop 194 can be reduced using a clamping assembly (not shown) to secure the craft material 195 between the inner hoop 193 and the outer hoop 194.

The adapter block 190 comprises a first structural means such as base portion 201 for securing the adapter block 190 to a clamp assembly 90 and a second structural means such as securement portion 202 for providing structure to which the inner hoop 193 of a hoop type craft frame 185 may be secured. The base portion 201 as shown in FIG. 14 preferably has a length approximately equivalent to the width of a clamp assembly 90. The base portion 201 includes a securement slot or groove 205 extending along an upper edge thereof adjacent the securement portion 202. The securement portion 202 has a length substantially shorter than the width of a clamp assembly 90 and is centrally and integrally formed with the base portion 201. The securement portion 202 includes an attachment bolt receiving aperture 210 extending centrally therethrough.

To use the adapter blocks 190 to secure a hoop type craft frame 185 to the stand 1, an adapter block 190 is secured to each of the clamp assemblies 90. An adapter block 190 is securable to a clamp assembly 90 by positioning the base portion 201 between the first clamp member 91 and the second clamp member 92 such that a portion of the base portion 201 adjacent the securement groove 205 extends into the first member inner groove 115 and a portion of the upper end 111 of the first clamp member 91 extends into the securement groove 205. The first and second clamp members 91 and 92 may then be advanced toward one another by tightening the bolt and wingnut assembly 150 so as to secure the adapter block 190 therebetween.

As is best seen in FIGS. 12 and 13, the inner hoop 193 is positioned slightly above and around the clamp assemblies 90, and the position of the clamp assemblies 90 are adjusted such that a front surface 211 of each adapter block 190 is positioned adjacent to and generally engages an inner surface 212 of the inner hoop 193. The inner hoop is positioned with respect to the adapter blocks 190 such that holes 215 drilled 180 degrees apart through the inner hoop 193 are aligned with the attachment bolt receiving aperture 210 in the adapter blocks 190. Attachment bolts 216 are then inserted through the holes 215 in the inner hoop 193 and through the attachment bolt receiving aperture 210 aligned therewith. The bolts 216 are Secured thereto using wingnuts 217.

Craft material 195 may then be positioned over the inner hoop 193 and secured thereto using the outer hoop 194 as discussed above. The outer hoop 194 is not secured to either an adapter block 190 or a clamp assembly 90. When it is desired to move the craft material 195 relative to the hoop type craft frame 185 secured to the stand 1 using the adapter blocks 190, the user simply removes the outer hoop 194, repositions the craft material 195 and resecures the outer hoop 194 over and around the craft material 195 and the inner hoop 193 so as to secure the craft material therebetween. If the hoop type craft frame 185 were secured directly to the clamp assemblies 90, the first and second clamp members 91 and 92 would have to be loosened and the craft frame 185 removed from therebetween each time the craft material 195 was to be repositioned on the craft frame 185.

The attachment bolts 216 and wingnuts 217 cooperating with the holes 215 and attachment bolt receiving aperture 210 generally function as securement means for securing the inner hoop 193 to the securement portion 202 of the adapter blocks 190. It is foreseen that other securement means could be utilized for securing the inner hoop 193 to the securement portion 202. In particular the securement portion 202 could include a hook into which the inner hoop 193 could be positioned, an adhesive could be used to fixedly secure the securement portion 202 of the adapter blocks 190 to the inner hoop 193 or the securement portion 202 could be integrally formed with the inner hoop 193.

It is to be understood that while certain forms of the present invention have been illustrated and described herein, it is not to be limited to the specific forms or arrangement of parts described and shown.

What is claimed and desired to be secured by Letters Patent is as follows:

1. A craft stand comprising:

(a) a base;

(b) a telescoping standard having an upper telescoping member and a lower hollow telescoping member; a lower end of said lower telescoping member attached to said base; said upper telescoping member is slidingly received within said lower telescoping member and advanceable between a raised alignment and a retracted alignment with respect to said lower telescoping member; said upper telescoping member includes a channel extending substantially across a length thereof and adapted to receive a pin secured to and extending inward from said lower telescoping member such that when said upper telescoping member is advanced to said raised alignment said pin engages a lower end edge of sad channel and prevents said lower telescoping member from advancing therebeyond;

(c) a frusto conical flexible washer slidingly positioned on said upper telescoping member; a lower end of said washer having an outer diameter that is smaller than an outer diameter of an upper end of said washer; the outer diameter of said washer lower end further being smaller than an inner diameter of said lower telescoping member and the outer diameter of said washer upper end being larger than the inner diameter of said lower telescoping member;

(d) a clamping nut comprising a cylindrical sleeve having a wall extending across an upper end thereof and having an upper telescoping member receiving aperture extending therethrough; said clamping nut being slidingly positioned on the upper telescoping member above said washer; said clamping nut threadingly securable to an upper end of the lower hollow member when said upper telescoping member is advanced to a desired alignment with respect to the lower telescoping member such that said wall of said clamping nut engages said upper end of said washer and urges said washer into said lower hollow member upper end such that an upper inner edge of the lower hollow member engages an outer surface of said washer and compresses said washer around said upper telescoping member to resist further retraction or extension of said upper telescoping member with respect to said lower telescoping member;

(e) a set screw threadingly secured within a set screw aperture extending through said lower telescoping member and threadingly advanceable to selectively engage said upper telescoping member to further resist retraction or extension of said upper telescoping member with respect to said lower telescoping member;

(f) a universal joint assembly attached to an upper end of said upper telescoping member;

(g) a cross arm having a middle and opposite ends; said cross arm connected to said universal joint assembly at said middle; and (h) a pair of clamp assemblies each attached to a respective cross arm opposite end and comprising:

(1) a first clamp member having a first member base and a first member upright extending perpendicular to said first member base at one end thereof; said first member base including side flanges extending upward from said first member base and away from said first member upright; said flanges including a front horizontal edge, a vertical edge and a rear horizontal edge; said vertical edge spaced from said first member upright by said front horizontal edge; said first member upright includes a first member inner groove on an inner surface of said first member upright and a first member outer groove on an outer surface of said first member upright and a plurality of bosses extends into each of said first member inner groove and outer groove;

(2) a second clamp member comprising a second member base and a second member upright extending perpendicularly to said second member base medially thereof; said second clamp member being positionable on said first clamp member such that said second base member is supported on said rear horizontal edge of said side flanges and a front edge of said second member base is positioned in abutting relationship with said vertical edge of said first member base; said second member upright includes a second member inner groove on an inner surface of said second member upright and a second member outer groove on an outer surface of said second member upright and a plurality of bosses extend into each of said second member inner groove and outer groove; and (3) connector means engaging said uprights and adapted for drawing upper ends of said uprights together.

2. The craft stand as disclosed in claim 1 further comprising an adapter block for securing a hoop type craft frame to said craft stand; said adapter block comprising:

(a) first structural means for securement between one of said clamp assemblies;

(b) second structural means secured to said first structural means and to which an inner hoop of said hoop type craft frame may be secured; and (c) securement means for securing said inner hoop to said second structural means such that said inner hoop is positioned beyond an upper edge of and around said clamp assemblies such that an outer hoop may be positioned over and around said inner hoop.

3. A craft stand comprising:

(a) a base;

(b) a telescoping standard having an upper telescoping member and a lower hollow telescoping member; a lower end of said lower telescoping member attached to said base; said upper telescoping member advanceable between a raised alignment and a retracted alignment with respect to said lower telescoping member;

(c) a universal joint assembly attached to an upper end of said upper telescoping member;

(d) a cross arm having a middle and opposite ends; said cross arm connected to said universal joint assembly at said middle;

(e) a pair of clamp assemblies comprising a pair of clamp members each of said clamp assemblies attached to a respective cross arm opposite end;

(f) position securement means selectively engageable for resisting advancement of said upper telescoping member with respect to said lower telescoping member for securing said cross arm at a selected height;

(g) said lower telescoping member is hollow; and (h) said upper telescoping member is slidingly received within said lower telescoping member; said upper telescoping member includes a channel extending substantially across a length thereof and adapted to receive a pin secured to and extending inward from said lower telescoping member such that when said upper telescoping member is advanced to said raised alignment said pin engages a lower end edge of said channel and prevents said lower telescoping member from advancing therebeyond.

4. The craft stand as disclosed in claim 3 wherein said position securement means comprises:

(a) a frusto conical flexible washer slidingly positioned on said upper telescoping member; a lower end of said washer having an outer diameter that is smaller than an outer diameter of an upper end of said washer; the outer diameter of said washer lower end further being smaller than an inner diameter of said lower telescoping member and the outer diameter of said washer upper end being larger than the inner diameter of said lower telescoping member; and (b) a clamping nut comprising a cylindrical sleeve having a wall extending across an upper end thereof and having an upper telescoping member receiving aperture extending therethrough; said clamping nut being slidingly positioned on the upper telescoping member above said washer; said clamping nut threadingly securable to an upper end of the lower hollow member when said upper telescoping member is advanced to a desired alignment with respect to the lower telescoping member such that said wall of said clamping nut engages said upper end of said washer and urges said washer into said lower hollow member upper end such that an upper inner edge of the lower hollow member engages an outer surface of said washer and compresses said washer around said upper telescoping member to resist further retraction or extension of said upper telescoping member with respect to said lower telescoping member.

5. The craft stand as disclosed in claim 4 further comprising:

(a) a set screw threadingly secured within a set screw aperture extending through said lower telescoping member and threadingly advanceable to selectively engage said upper telescoping member to further resist retraction or extension of said upper telescoping member with respect to said lower telescoping member.

6. A craft stand comprising:

(a) a base;

(b) a standard having a lower end secured to said base;

(c) a universal joint assembly attached to an upper end of said standard;

(d) a cross arm having a middle and opposite ends; said cross arm connected to said universal joint assembly at said middle; and (e) a pair of clamp assemblies each attached to a respective cross arm opposite end and comprising (1) a first clamp member having a first member base and a first member upright extending perpendicular to said first member base at one end thereof; said first member base including side flanges extending upward from said first member base and away from said first member upright; said flanges including a front horizontal edge, a vertical edge and a rear horizontal edge; said vertical edge spaced from said first member upright by said front horizontal edge;

(2) a second clamp member comprising a second member base and a second member upright extending perpendicularly to said second member base medially thereof; said second clamp member being positionable on said first clamp member such that said second base member is supported on said rear horizontal edge of said side flanges and a front edge of said second member base is positioned in abutting relationship with said vertical edge of said first member base; and (3) connector means engaging said uprights and adapted for drawing upper ends of said uprights together.

7. The craft stand as disclosed in claim 6 further comprising an adapter block for securing a hoop type craft frame to said craft stand; said adapter block comprising:

(a) first structural means for securement between one of said clamp assemblies;

(b) second structural means secured to said first structural means and to which an inner hoop of said hoop type craft frame may be secured; and (c) securement means for securing said inner hoop to said second structural means such that said inner hoop is positioned beyond an upper edge of and around said clamp assemblies such that an outer hoop may be positioned over and around said inner hoop.

8. The craft stand as disclosed in claim 6 wherein:

(a) said first member upright includes a first member inner groove on an inner surface of said first member upright and a first member outer groove on an outer surface of said first member upright and a plurality of bosses extends into each of said first member inner groove and outer groove; and (b) said second member upright includes a second member inner groove on an inner surface of said second member upright and a second member outer groove on an outer surface of said second member upright and a plurality of bosses extend into each of said second member inner groove and outer groove.

9. A craft stand comprising:

(a) a base;

(b) a telescoping standard having an upper telescoping member and a lower hollow telescoping member; a lower end of said lower telescoping member attached to said base and said upper telescoping member advanceable between a raised alignment and a retracted alignment with respect to said lower telescoping member;

(c) a universal joint assembly attached to an upper end of said upper telescoping member;

(d) a cross arm having a middle and opposite ends; said cross arm connected to said universal joint assembly at said middle;

(e) a pair of clamp assemblies each attached to a respective cross arm opposite end and comprising:

(1) a first clamp member having a first member base and a first member upright extending perpendicular to said first member base at one end thereof; said first member base including side flanges extending upward from said first member base and away from said first member upright; said flanges including a front horizontal edge, a vertical edge and a rear horizontal edge; said vertical edge spaced from said first member upright by said front horizontal edge;

(2) a second clamp member comprising a second member base and a second member upright extending perpendicularly to said second member base medially thereof; said second clamp member being positionable on said first clamp member such that said second base member is supported on said rear horizontal edge of said side flanges and a front edge of said second member base is positioned in abutting relationship with said vertical edge of said first member base; and (3) connector means engaging said uprights and adapted for drawing upper ends of said uprights together; and (f) position securement means selectively engageable for resisting advancement of said upper telescoping member with respect to said lower telescoping member for securing said cross arm at a selected height.

10. The craft stand as disclosed in claim 9 further comprising an adapter block for securing a hoop type craft frame to said craft stand; said adapter block comprising:

(a) first structural means for securement between one of said clamp assemblies;

(b) second structural means secured to said first structural means and to which an inner hoop of said hoop type craft frame may be secured; and (c) securement means for securing said inner hoop to said second structural means such that said inner hoop is positioned beyond an upper edge of and around said clamp assemblies such that an outer hoop may be positioned over and around said inner hoop.

11. The craft stand as disclosed in claim 9 wherein:

(a) said lower telescoping member is hollow; and (b) said upper telescoping member is slidingly received within said lower telescoping member; said upper telescoping member includes a channel extending substantially across a length thereof and adapted to receive a pin secured to and extending inward from said lower telescoping member such that when said upper telescoping member is advanced to said raised alignment said pin engages a lower end edge of said channel and prevents said lower telescoping member from advancing therebeyond.

12. The craft stand as disclosed in claim 11 wherein said position securement means comprises:

(a) a frusto conical flexible washer slidingly positioned on said upper telescoping member; a lower end of said washer having an outer diameter that is smaller than an outer diameter of an upper end of said washer; the outer diameter of said washer lower end further being smaller than an inner diameter of said lower telescoping member and the outer diameter of said washer upper end being larger than the inner diameter of said lower telescoping member; and (b) a clamping nut comprising a cylindrical sleeve having a wall extending across an upper end thereof and having an upper telescoping member receiving aperture extending therethrough; said clamping nut being slidingly positioned on the upper telescoping member above said washer; said clamping nut threadingly securable to an upper end of the lower hollow member when said upper telescoping member is advanced to a desired alignment with respect to the lower telescoping member such that said wall of said clamping nut engages said upper end of said washer and urges said washer into said lower hollow member upper end such that an upper inner edge of the lower hollow member engages an outer surface of said washer and compresses said washer around said upper telescoping member to resist further retraction or extension of said upper telescoping member with respect to said lower telescoping member.

13. The craft stand as disclosed in claim 12 further comprising:

(a) a set screw threadingly secured within a set screw aperture extending through said lower telescoping member and threadingly advanceable to selectively engage said upper telescoping member to further resist retraction or extension of said upper telescoping member with respect to said lower telescoping member.

14. The craft stand as disclosed in claim 9 wherein:

(a) said first member upright includes an inner groove on a first member inner surface of said first member upright and a first member outer groove on an outer surface of said first member upright and a plurality of bosses extends into each of said first member inner groove and outer groove; and (b) said second member upright includes a second member inner groove on an inner surface of said second member upright and a second member outer groove on an outer surface of said second member upright and a plurality of bosses extend into each of said second member inner groove and outer groove.

15. A craft stand comprising:

(a) a base;

(b) a telescoping standard having an upper telescoping member and a lower hollow telescoping member; a lower end of said lower telescoping member attached to said base and said upper telescoping member advanceable between a raised alignment and a retracted alignment with respect to said lower telescoping member;

(c) a universal joint assembly attached to an upper end of said upper telescoping member;

(d) a cross arm having a middle and opposite ends; said cross arm connected to said universal joint assembly at said middle;

(e) a pair of clamp assemblies comprising a pair of clamp members; each of said clamp assemblies attached to a respective cross arm opposite end;

(f) position securement means selectively engageable for resisting advancement of said upper telescoping member with respect to said lower telescoping member for securing said cross arm at a selected height; and (g) an adapter block for securing a hoop type craft frame to said craft stand; said adapter block comprising:

i. first structural means for securement between one of said clamp assemblies;

ii. second structural means secured to said first structural means and to which an inner hoop of said hoop type craft frame may be secured; and iii. securement means for securing said inner hoop to said second structural means such that said inner hoop is positioned beyond an upper edge of and around said clamp assemblies such that an outer hoop may be positioned over and around said inner hoop.

* * * * *